United States Patent [19]

Hare

[11] Patent Number: 4,793,376

[45] Date of Patent: Dec. 27, 1988

[54] PORTABLE, RECOILABLE HOSE SYSTEM

[75] Inventor: Larry L. Hare, Bellingham, Wash.

[73] Assignee: Wayne L. Hare

[21] Appl. No.: 37,879

[22] Filed: Apr. 13, 1987

[51] Int. Cl.[4] ..... B65H 75/34

[52] U.S. Cl. ..... 137/355.23; 137/355.27; 242/86

[58] Field of Search ..... 137/355.21, 355.23, 137/355.26, 355.27; 242/86

[56] References Cited

U.S. PATENT DOCUMENTS

| | | | |
|---|---|---|---|
| 394,556 | 12/1888 | Coleman | 137/355.16 |
| 446,745 | 2/1891 | Schenck | 137/355.26 |
| 706,968 | 8/1902 | Mond | 137/355.16 |
| 902,801 | 11/1908 | Bergland | 137/355.16 |
| 1,683,911 | 9/1928 | Morris | 137/355.16 |
| 2,299,521 | 10/1942 | Zierden | 299/78 |
| 2,496,489 | 2/1950 | Palm | 299/78 |
| 2,514,862 | 7/1950 | Hannay | 299/78 |
| 2,519,064 | 8/1950 | Palm | 299/79 |
| 2,533,432 | 12/1950 | Clark | 242/86 |
| 2,547,826 | 4/1951 | Kirschner | 299/78 |
| 2,568,929 | 9/1951 | Palm | 299/78 |
| 2,583,151 | 1/1952 | Moonshower | 299/78 |
| 2,696,406 | 12/1954 | Myers | 137/355.26 |
| 2,871,057 | 1/1959 | Bernyk | 299/78 |
| 3,437,105 | 4/1969 | Stracek | 137/355.23 |
| 3,445,066 | 5/1969 | Mohar | 239/189 |
| 3,612,094 | 10/1971 | Hare | 137/355.2 |
| 3,820,559 | 6/1974 | Griffiths et al. | 137/355.16 |
| 3,822,719 | 7/1974 | Nederman | 137/355.26 |
| 4,227,661 | 10/1980 | King et al. | 137/355.27 |
| 4,446,884 | 5/1984 | Rader, Jr. | 137/355.23 |
| 4,537,215 | 8/1985 | Roman | 137/355.26 |

*Primary Examiner*—A. Michael Chambers

*Attorney, Agent, or Firm*—Allegretti & Witcoff, Ltd.

[57] ABSTRACT

A portable, recoilable garden hose system is disclosed that stores, protects, and cleans a variety of conventional hoses. A housing defines a sealed, inner chamber in which a reel rotates on a shaft to wind and unwind the hose. A band spring and brake mechanism control the reel's rotation and are also enclosed inside the housing, although a brake knob used to activate the brake system is conveniently located outside the housing. The system also includes a pipe structure for carrying water from an outside faucet to the hose fitting within the housing. Outside the housing, the system includes a support bracket for mounting the housing and fixing the shaft within the housing. The lower end of this support bracket can be mounted in the ground, on vehicles, or on other supports.

2 Claims, 3 Drawing Sheets

PORTABLE, RECOILABLE HOSE SYSTEM

BACKGROUND OF THE INVENTION

The present invention relates generally to a remote control recoilable hose. More specifically, the device according to this invention refers to a portable, recoilable hose system for use on trailers, boats, trucks, and the like as well as in gardens and on lawns.

The device includes an integral housing which defines a sealed, protected inner chamber. A reel is positioned inside this chamber and can rotate to wind or unwind coils of hose on or off the reel. A band spring attached to the reel inside the chamber stores tension energy upon rotation of the reel in one direction when the hose is unwound; the stored energy automatically causes the reel to rotate in the opposite direction and wind the hose when the hose and brake are released. A brake mechanism also contained inside the chamber controls the reel's rotation, but the brake knob used to activate the brake mechanism is conveniently located outside the housing.

Outside the housing, the device has a support bracket for mounting the housing and fixing the reel within the housing. The lower end of this support bracket can be mounted in the ground, on vehicles, or on other supports. Finally, the device includes a pipe structure for carrying water from an outside source to the hose fitting within the portable, recoilable hose system.

Ordinary hoses are difficult to store unless a coiling system is used. Presently known systems for coiling and storing hose are of two general types: portable and fixed. Portable systems have the advantage of movement and they can be positioned where needed. This advantage is also a disadvantage, however, because the systems are often heavy and must be carried from a storage area to the place of use. Then the hose must be coupled to the water source, and uncoupled after use. This repeated coupling and uncoupling of the hose facilitates leakage. Moreover, portable systems are often left outside where the environmental effects, such as the sun's ultraviolet rays, weaken the hose and other system components.

Presently known fixed systems also have advantages and disadvantages. They often have covers to protect the system components from the environment. The hoses in such systems can remain permanently attached to a water source and tend to reduce leakage. Therefore, fixed systems reduce the time and effort required to connect the system to a water source. These systems also reduce the time and effort required to transport the system to the area of use. If a leak does occur in a fixed system, however, it may damage the area in which the system is stored. Moreover, such a system may be unable to reach an area of use without an impractically long hose.

Whether portable or fixed, some systems offer the advantage of automatic recoiling of the hose. Automatic recoilers ususally require that the hose be completely withdrawn from the reel. In addition, they may fail to recoil the hose completely on the reel, leaving a section of hose dangling from the reel.

One system, that disclosed in U.S. Pat. No. 3,612,094 issued to William R. Hare, uses a brake device so that the hose will recoil automatically even when it is not competely withdrawn from the reel. A vertical lever arm interacts with teeth provided around the outer surface of the reel. Such an interaction risks slippage of the lever arm over the teeth. Moreover, the lever arm pivots around a pin which tends to slip out of the lever, rendering the brake device inoperable.

SUMMARY OF THE INVENTION

It is an object of the invention to provide a portable system that can recoil hoses and retain the advantages, while avoiding the disadvantages, of the known systems. More specifically, one object of the invention is to combine the features of portable systems, fixed systems, and automatic recoilable systems with solutions to the problems recognized in these systems by the inventor.

An object of the automatic recoiling feature of the invention is to clean, drain, and store the hose. As the hose is coiled on the reel and stored within the housing of the invention, it passes through a hole with a surrounding abutment for cleaning and draining the hose. This action achieves a related object, eliminating the messy chore of wrapping wet, dirty hose after use.

An improved break mechanism in the hose system achieves the object of recoiling the hose fully after any desired length of hose is withdrawn from the reel. This brake incorporates a combined rotational and translational action between the break lock catch and brake tooth gear to achieve additional objects: the prevention of accidental recoiling and the reduction of risk of brake slippage.

Ease of operation is desirable; therefore, it is an object of the invention. The hose exits the housing at a convenient height. A pull on the hose to the desired length followed by a turn of the water valve to the desire pressure are the only actions required to use the hose system. The brake mechanism is controlled remotely. Thus, to store the hose after use only a push on the brake release and a turn of the water valve are necessary. The ease of operation achieves the related objects of saving time and energy, and providing quick and easy storage of the hose.

A system that prevents inadvertent engagement of the brake mechanism during unwinding of the hose represents a further object of this invention. A stop on the brake knob provides this safeguard. A system that protects the hose and structural components of the system from the environment when not in use is also desireable. The housing of the invention attains this goal.

Because the system of the invention is portable, it can achieve further objects. One object is compatibility with existing outside water sources, and the threaded hose mount of the invention achieves this object. A second object is reduced weight so that the system can be carried easily. The system uses durable, but light, materials so that the combined weight of the system and fifty feet of conventional hose is merely thirty pounds. A compact structure is a third object which fosters portability. The system can use a variety of hose types, including flat hoses and shorter length hoses, which require less storage area and achieve compactness. Even the standard embodiment of the invention, however, is a compact 18.75 inches deep, 18.75 inches high, and 9.75 inches wide.

Another object is adaptability. The hose reel can be swiveled around the stantion to point the hose in different directions. The stantion can be mounted to a variety of vehicles and supports, as well as the ground, and can accept a conventional chain and lock to prevent theft of the hose system. A number of hose systems according to the present invention could operates in series to cover large areas. Finally, the invention is quick and easy to install. All of these advantages offered by the invention create an adaptable system.

A system that is inexpensive to purchase and that requires little maintenance are further objects. Because the invention uses conventional, durable materials, it achieves these objects. The careful design of the system components prevents water leakage, an object of any hose system.

Finally, it is an object of the invention to eliminate unsightly hoses crossing lawns, walks, and driveways. A portable, recoilable hose system according to the present invention will help achieve this object. Further objects and advantages of the present invention will be apparent from the following detailed description and the claims, when considered with the accompanying drawing.

BRIEF DESCRIPTION OF THE DRAWING

For a better understanding of the invention, reference is made to the accompanying drawing, in which.

DETAILED DESCRIPTION OF THE PREFERRED EMBODIMENT

Figure 1:
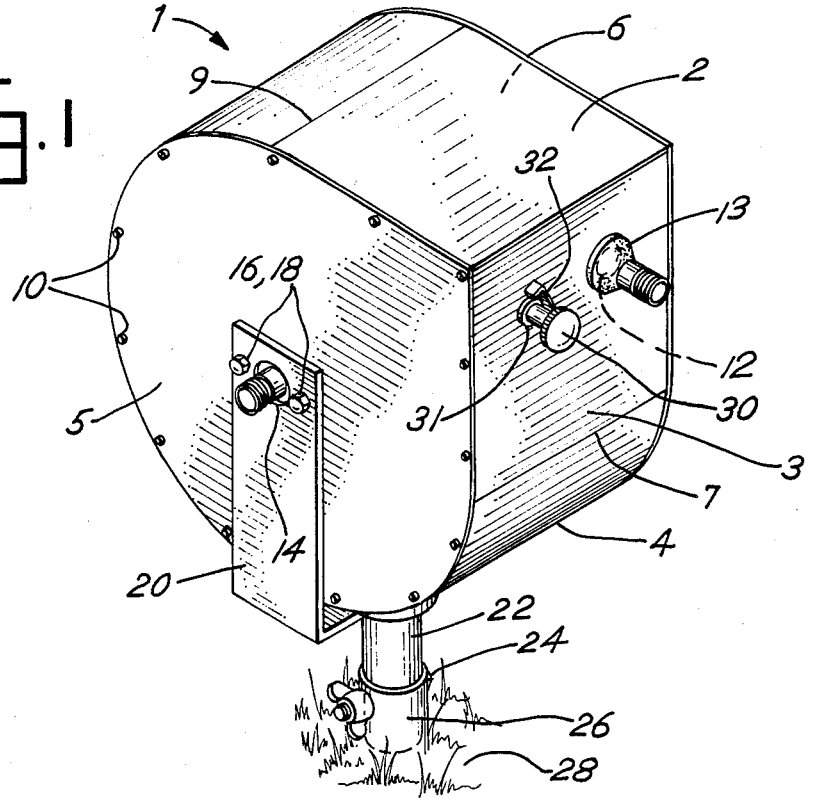
FIG. 1 is an isometric view of the hose system housing and support.
Figure 2:
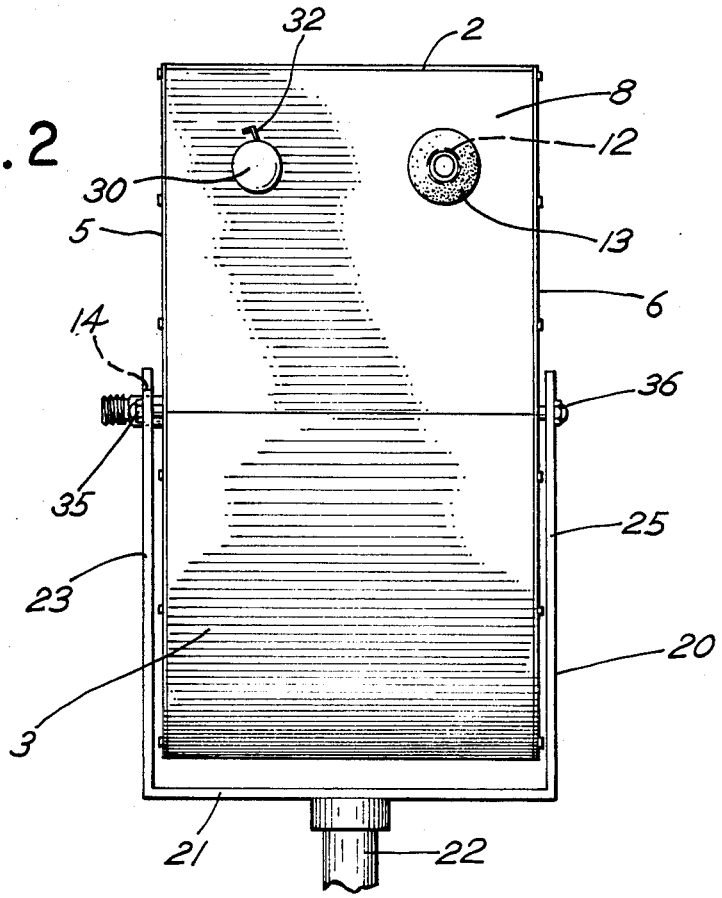
FIG. 2 is a front view of the hose system housing and support.

Referring to FIGS. 1 and 2, a housing 1 has a top plate 2, a front plate 3, a curved bottom plate 4 which wraps from the lower edge 7 of front plate 3 to the rear edge 9 of top plate 2, a left side plate 5, and a right side plate 6 which form an integral housing 1 providing a sealed, protected inner chamber 8 when attachment members 10 connect the housing elements 2, 3, 4, 5 and 6. In this preferred embodiment, the attachment members 10 are screws but they could be nuts and bolts or other conventional connectors. The members 10 attaching the left side plate 5 are easily removable to allow easy access to the inner chamber 8 of housing 1.

The removal of the left side plate 5 will not collapse the housing 1; the plates 2–6 of housing 1 are made of a relatively stiff material. Although a variety of materials are appropriate for making the housing 1, such as stiff plastic, the housing 1 can be made of sheet metal having a thickness of approximately 0.016 inches. The housing 1 defines a chamber 8 having the approximate dimensions 18.75 inches in depth, 18.75 inches in height, and 9.75 inches in width. Housing 1 should be compact. As will suggest itself, other dimensions are possible.

Front plate 3 of housing 1 includes a hole 12 through which a garden hose 110 (FIG. 3) passes. Abutment 13 surrounds the hole 12 and cleans and drains the hose 110 as it passes through hole 12. The abutment 13 also engages the hose stopper 126 on the end of hose 110 to prevent hose 110 from recoiling completely into housing 1. Plastic or rubber are suitable materials for abutment 13. Front plate 3 of housing 1 also has a mount 31 to locate the brake knob 30.

Figure 3:
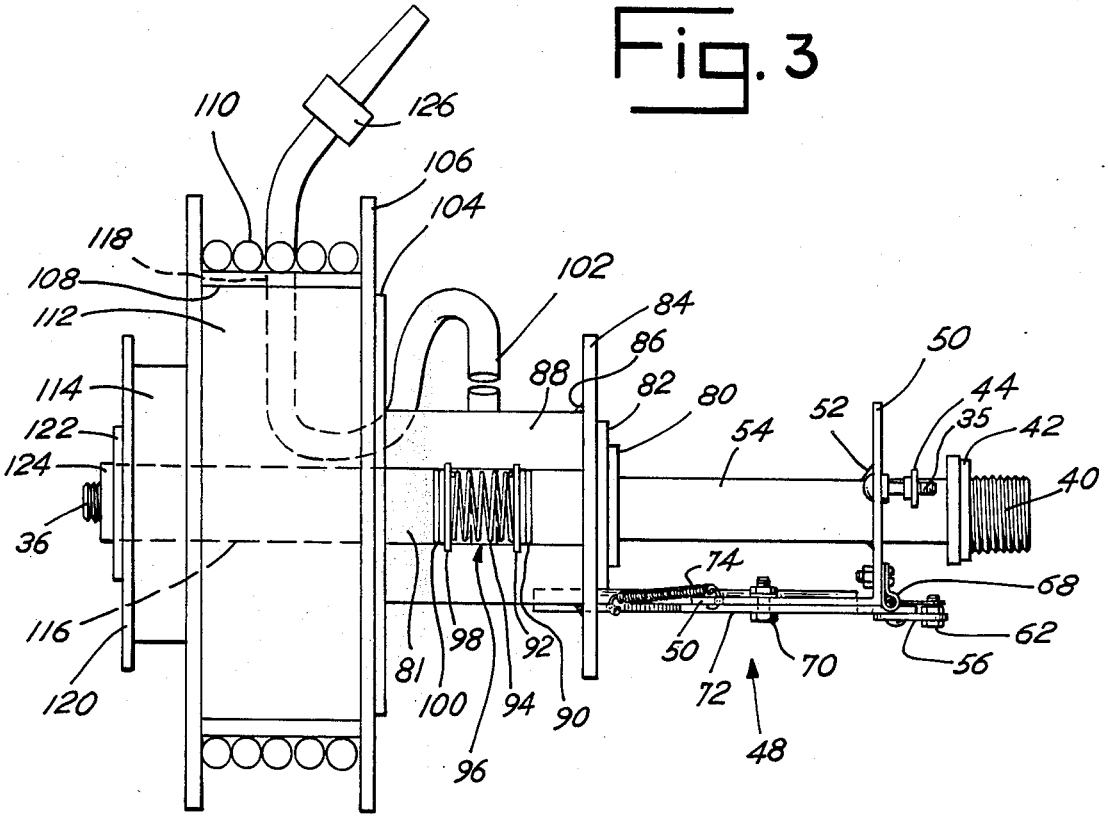
FIG. 3 is a side view of the hose system without the housing or support present, and showing the internal elements of the tee pipe.

An aperture 14 in left side plate 5 of housing 1 receives the threaded hose mount 40 (FIG. 3). A pair of openings 16, 18 in left side plate 5 receive a pair of bolts 35 (one shown in FIG. 3) that attach support bracket 20 to housing 1. Washer 44 helps to assure a proper fit between support bracket 20 and housing 1. Similarly, a second pair of openings (not shown) in right side plate 6 receive the additional bolts 36 that attach support bracket 20 to housing 1.

To support and mount housing 1 and the components protected within the inner chamber 8, the invention provides a support bracket 20. This support bracket 20 is an integral, U-shaped yoke having a center portion 21, a first upright 23 attached to one end of center portion 21, a second upright 25 attached to the opposite end of center portion 21, and a stantion 22 (see FIG. 2). The uprights 23, 25 extend perpendicularly from center portion in an upward direction and the stantion 22, which is centrally attached to the bottom of center portion 21, extends perpendicularly down from center portion 21 in the opposite direction.

Support bracket 20 also includes a support strut 26. Strut 26 has an inner diameter slightly larger than the outer diameter of stantion 22 so that it fits over stantion 22. The head of strut 26 mates with the free end of stantion 22. The foot of strut 26 can be attached to another support, to a vehicle such as a trailer, truck, car, boat, and the like, or directly to the ground 28 as shown in FIG. 1.

A coupling connector 24 couples the stantion 22 and support strut 26. In this preferred embodiment, the coupling connector 24 is a thread on the head of support strut 26 and a mating thread on stantion 22. Another example of an appropriate coupling connector 24 is a bolt and wing nut as shown in FIG. 1, with the bolt portion passing through a bore (not shown) in the mating surfaces of support strut 26 and stantion 22. Any coupling connector 24 that allows the support bracket 20 to releasably mount the housing 1 and the components protected within the inner chamber 8, however, and to allow stantion 22 to swivel on support strut 26, is appropriate.

The first upright 23 of the support bracket 20 has an aperture 14 to receive the threaded hose mount 40. This upright 23 also has a pair of openings 16, 18 to receive the bolts 35 that attach the support bracket 20 to the housing 1. Similarly, the second upright 25 has a second pair of openings (not shown) to receive the additional bolts 36 that attach the support bracket 20 to the housing 1.

Although the support bracket 20 must be sturdy, it may be made from a variety of sturdy materials. In this preferred embodiment, the material is metal having a thickness of about 0.125 inches. The dimensions of support bracket 20 are also variable. A central portion 21 which is 9.75 inches long and 4 inches wide, and uprights 23,25 which are 4 inches wide and 11.75 inches high, provide sufficient sturdiness. This preferred embodiment also includes round pipe as the support strut 26 and stantion 22, with strut 26 having an inner diameter of 1.375 inches and the stantion 22 having an outer diameter of 1.25 inches.

As shown in FIG. 3, a remote control brake mechanism 48 controls the rotation of a hose reel shaft 116. Brake mechanism 48 has an L-shaped bracket plate 50 (FIG. 5) having an arm 51 and a leg member 53. FIG. 3 shows that the arm 51 is secured to the connecting pipe 54 by, for example, a first weld 52. It is preferred, however, to form arm 51 and connecting pipe 54 as an integral structure. Arm 51 also has a pair of bolt holes 71,73

(FIG. 5) to receive bolts 35 that attach brake mechanism 48 to housing 1 and housing 1 to support bracket 20.

A planar base plate 72 (FIGS. 4 and 5) is rotatably fixed to bracket plate 50 by a plate bolt 70. A flat lock catch 76 if formed integral to base plate 72 and extends downward from the plane of plate 72 at about a 45 degree angle. The lock catch 76 extends beyond the edge of base plate 72 for engagement with a tooth gear 84.

Tooth gear 84 is fixed with respect to hose reel shaft 116 for rotation therewith relative to the bracket plate 50 and base plate 72. Tooth gear 84 has a plurality of teeth 85 to engage lock catch 76. Although one tooth 85 is sufficient, a number of teeth 85 is preferable and the preferred embodiment has four teeth. As shown in FIG. 3, tooth gear 84 is secured to a tee pipe 88, by, for example a weld 86. It is preferred, however, to form tooth gear 84 and tee pipe 88 as an integral structure.

Figure 5:
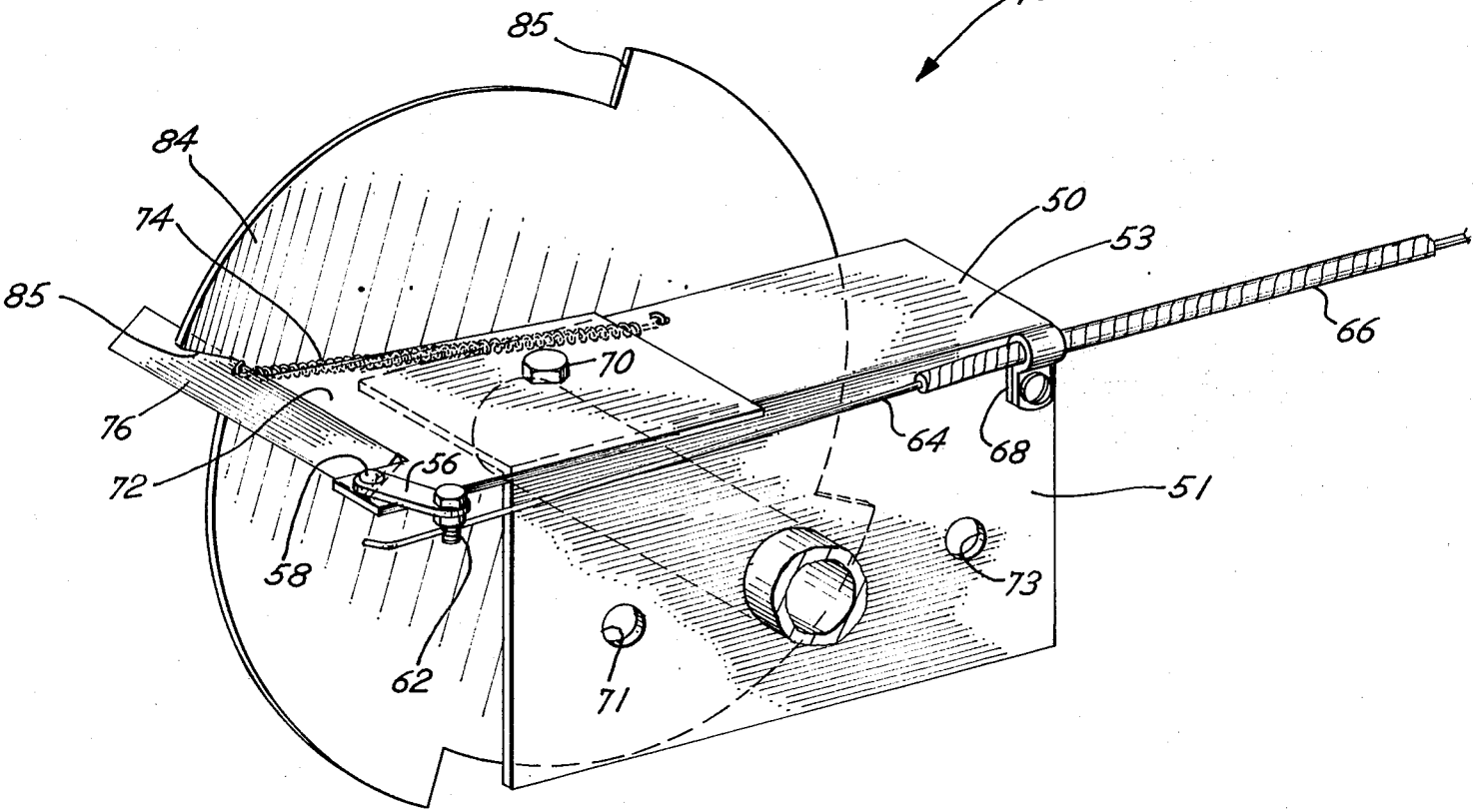
FIG. 5 is an isometric view of the brake mechanism.

Referring again to FIG. 5, a retension spring 74 is attached at one end to lock catch 76 and at an opposite end to bracket plate 50. As shown in FIG. 5, spring 74 passes underneath base plate 72 (FIG. 3 shows the spring 74 passing over the base plate 72 because FIG. 3 shows the brake mechanism 48 rotated 90 degrees relative to the brake mechanism in FIG. 5). The retension spring 74 biases the lock catch 76 against tooth gear 84 when the brake knob 80 is released.

Figure 4:
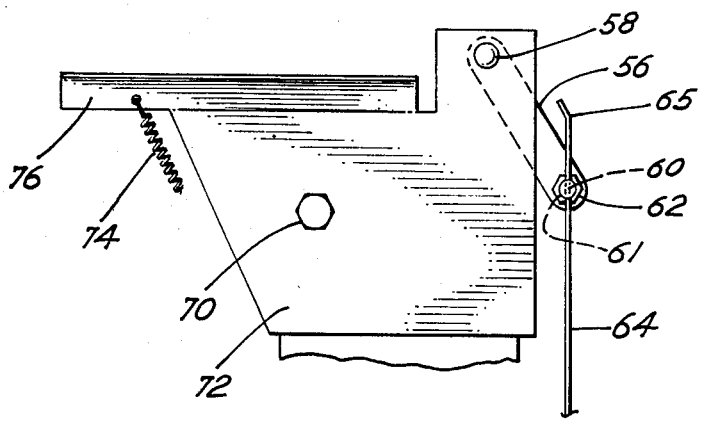
FIG. 4 is a top view of the base plate portion of the brake mechanism.

As shown in FIG. 4, brake mechanism 48 includes a pivot clip 56 which is rotatably fixed to the base plate 72 by a single rivet, bolt, or the like at 58. Pivot clip 56 has an opening or void 61 which receives a carriage 62 for carrying one end of a cable wire 64. Although a variety of types of carriages 62 are possible, the embodiment shown uses a nut and bolt with the bolt having a pilot hole 60 through which wire 64 passes. A bend 65 in the wire 64 prevents it from disengaging the pilot hole 60.

A cable wire case 66 (FIG. 5) surrounds the cable wire 64 to protect it. Case 66 extends from near one end of the wire 64, where the wire 64 attaches to the brake knob 30, to near the opposite end of wire 64, where wire 64 and case 66 pass through a cable case clamp 68 (FIG. 5). Cable case clamp 68 is fixedly attached to the arm 51 of the bracket plate 50; it secures the cable wire case 66 to bracket plate 50 and prevents wire 64 from interfering with other structures.

Finally, brake mechanism 48 includes a brake knob 30 (FIGS. 1 and 2) for engaging and disengaging brake mechanism 48. The brake knob 30 is positioned on the outside of housing 1 at a location remote from the remainder of the brake mechanism 48. The brake knob 30 sits in the mount 31 in the front plate 3 of housing 1, extending about 2.5 inches outwardly beyond the housing 1. Knob 30 is secured to one end of wire 64.

To disengage brake mechanism 48, brake knob 30 is pulled outwardly away from housing 1. This action pulls cable wire 64, which pulls carriage 62, which pulls pivot clip 56, which causes translational motion of lock catch 76 away from tooth gear 84 in a plane perpendicular to tooth gear 84. This action allows tooth gear 84 to rotate relative to lock catch 76. A stop 32 (FIGS. 1, 2) prevents the brake knob 30 from sliding back against the housing 1 and engaging the brake mechanism 48 by sitting between the end of the brake knob 30 and housing 1.

The combination of the translational and rotational motion because lock catch 76 and tooth gear 84 provides a unique stopping action. Because lock catch 76 perpendicularly engages tooth gear 84, lock catch 76 presents a large area for gear tooth or teeth 85 to catch on lock catch 76. Thus, slippage between lock catch 76 and tooth gear 84 is reduced.

To engage brake mechanism 48 and prevent rotation of tooth gear 84 and reel shaft 116 relative to lock catch 76, stop 32 is manually released and brake knob 30 is pushed back against the housing 1. This action allows the retension spring 74 to force the lock catch 76 against the tooth gear 84, thereby engaging the tooth or teeth 85.

As shown in FIG. 3, water enters the hose system of the present invention from an external source (not shown), as for example of outdoor water faucet, through a threaded hose mount 40. A connecting pipe 54 attaches to hose mount 40 on the end opposite the end to be connected to the external water source. The bracket plate 50 of brake mechanism 48 can be attached to, or as is preferred, integrally formed with, connecting pipe 54. A rubber seal 42 is placed over hose mount 40 to prevent leakage.

A tee pipe 88 attaches (1) to the connecting pipe 54 at one outlet of the tee, (2) to a hose fitting 102 of the graden hose 110 at a second outlet, and (3) to the reel shaft 16 at the third tee outlet. Tee pipe 88 has a center hole 96 to carry water, which has passed through hose mount 40, through connecting pipe 54, and to tee pipe 88, into hose fitting 102. Hose fitting 102 then carries the water to hose 110, because it connects tee pipe 88 to hose 110. Although tooth gear 84 can be secured to tee pipe 88 by, for example, a weld 86, it is preferred to form tooth gear 84 and tee pipe 88 integrally.

Tee pipe 88 contains internal structure as is shown in FIG. 3, although this structure would not normally be visible in the side view shown. This internal structure includes a first pair of O-rings 90 between a first bushing 80 and a first shim 92. First shim 92 prevents vibration, assures constant pressure on first bushing 80 to stop leaks, and protects first pair of O-rings 90 from damage by wire spring 94. Wire spring 94 places constant pressure on first and second shims 92,98.

The internal structure of tee pipe 88 also includes a second shim 98 to prevent vibration, assure constant pressure on second bushing 81 to stop leaks, and protect second pair of O-rings 100 from damage by wire spring 94. Second pair of O-rings 100, between second bushing 81 and second shim 98, stops leaks. Although FIG. 3 shows the internal structure of tee pipe 88 as separate elements, it is preferred to construct these elements as a single, integral structure.

To provide a surface for coiling hose 110, a reel center core 112 is provided. Core 112 is round and contains a center passage for mounting on reel shaft 116 and rotating relative to connecting pipe 54. Core 112 has a pair of rims 106 integrally attached to opposite ends of core 112 for containing hose 110. Core 112 and rims 106 are made of a light, but durable, material such as resilient plastic. To provide additional strength and to prevent core 112 from tipping, a steel plate 108 surrounds core 112. An orifice 118 is provided in core 112 to allow the hose fitting 102 to reach the hose 110.

Although FIG. 3 shows core 112 to the side of tee pipe 88, it is preferred that core 112 fits over tee pipe 88. In this preferred embodiment, hose fitting 102 is vertical as it enters orifice 118 in the top of core 112 to meet hose 110.

A band spring 114 is attached to reel shaft 116. When hose 110 is unwound in one direction, reel shaft 116 rotates and places band spring 114 in tension. Engagement of brake mechanism 48 forces band spring 114 to store this tension energy. After brake mechanism 48 is released, the stored energy causes band spring 114 to rotate reel shaft 116 and wind hose 110 onto reel core 112.

Bushings 81, 82 facilitate rotation of reel shaft 116, tee pipe 88, and tooth gear 84 relative to connecting pipe 54, brake mechanism 48 and hose mount 40. Plastic spacers 82 and 104 help bushings 81,82 to perform this function. A circular plastic plate 120 retains band spring 114 against the reel and fits around tee pipe 88. A metal plate 122 provides strength and a place to mount bolts 36. An end cap 124 seals tee pipe 88.

A preferred embodiment of the present invention has been disclosed. The entire system of this invention, when it includes fifty feet of hose 116, weighs about thirty pounds. Various changes and modifications can be made, however, without departing from the true scope and spirit of the present invention as set forth and defined in the following claims.

What is claimed is:

1. In a recoilable hose winding device comprising two stationary members:

(1) a stationary support bracket having a pair of uprights; and (2) a stationary shaft disposed between said uprights;

a reel member rotatably mounted on said shaft for paying out, retaining, or winding in a hose;

a band spring having two ends wherein one end is affixed to said reel and the second end is affixed to either of said stationary members, said band spring being placed in tension by rotation of said reel member during said paying out of said hose; and a braking mechanism;

said improvement comprising adding a remote control brake mechanism wherein said brake mechanism comprises:

a stationary bracket plate;

a planar base plate pivotally affixed to said stationary bracket plate;

a ratchet-like tooth gear rotationally affixed to said reel and positioned adjacent to said planar base plate such that the plane of said ratchet-like tooth gear is perpendicular to the plane of said base plate, said ratchet-like tooth gear having at least one tooth;

a lock catch coplanar with said planar base plate and rigidly affixed thereto such that one end of said lock catch projects outwardly from said lock catch-base plate combination toward said ratchet-like tooth gear for a distance sufficient to perpendicularly engage said tooth gear via a tooth thereon;

a retention spring having a first end and a second end, said first end affixed to said lock catch at the end proximate to said tooth gear, said second end affixed to said bracket plate so as to maintain a tension in said spring whereby said tension acts to pivot said lock catch-base plate combination toward said ratchet-like gear so as to cause said lock catch to perpendicularly engage one said tooth of said ratchet-like tooth gear thereby preventing rotation of said tooth gear in a second direction of rotation ("prevented direction");

a cable wire affixed to said planar base plate at a point distal to said ratchet-like tooth gear, whereby when sufficient tension is drawn on said cable wire said lock catch-base plate combination pivots away from said ratchet-like tooth gear, causing said lock catch to disengage said tooth thereby permitting said ratchet-like tooth gear to freely rotate in said otherwise prevented direction.

2. A portable recoilable hose winding device comprising:

a stationary support bracket having a pair of uprights;

a stantion rigidly affixed to the base of said stationary support bracket;

a strut implanted in the ground for receiving said stantion;

a stationary shaft disposed between said uprights;

a reel member rotatably mounted on said shaft for paying out, retaining, or winding in a hose;

a band spring having two ends wherein a first end is affixed to said reel member and a second opposite end is affixed to a stationary member, said band spring being place in tension by rotation of said reel member during said paying out of said hose; and a braking mechanism comprising:

(a) a stationary bracket plate;

(b) a planar base pivotally affixed to said stationary bracket plate;

(c) a ratchet-like gear rotationally affixed adjacent to said planar base plate such that the plane of said ratchet-like tooth gear is perpendicular to the plane of said ratchet-like tooth gear having at least one tooth;

(d) a lock catch coplanar with said planar base plate and rigidly affixed thereto, such that one end of said lock catch projects outwardly from said lock catch-base plate combination toward said ratchet-like tooth gear for a distance sufficient to perpendicularly to engage said tooth gear via a tooth thereon;

(e) a retention spring having a first end and a second end, said first end affixed to said lock catch at the end proximate to said tooth gear, said second end affixed to said bracket plate so as to maintain a tension in said spring, whereby said tension acts to pivot said lock catch-base plate combination toward said tooth gear so as to cause said lock catch to perpendicularly engage one said tooth of said ratchet-like tooth gear thereby preventing rotation of said gear in second direction of rotation ("prevented direction"); and (f) a cable wire affixed to said planar base plate at a point distal to said ratchet like tooth gear, whereby when sufficient tension is drawn on said cable wire said lock catch-base plate combination pivots away from said ratchet-like tooth gear, causing said lock catch to disengage said tooth thereby permitting said ratchet-like tooth gear to freely rotate in said otherwise prevented direction.

* * * * *